US010660388B2

(12) United States Patent
Lotti

(10) Patent No.: US 10,660,388 B2
(45) Date of Patent: May 26, 2020

(54) ARTIFICIAL LASH EXTENSIONS

(71) Applicant: LASHIFY, INC., Los Angeles, CA (US)

(72) Inventor: Sahara Lotti, Los Angeles, CA (US)

(73) Assignee: Lashify, Inc., Los Angeles, CA (US)

( * ) Notice: Subject to any disclaimer, the term of this patent is extended or adjusted under 35 U.S.C. 154(b) by 0 days.

(21) Appl. No.: 15/968,361

(22) Filed: May 1, 2018

(65) Prior Publication Data

US 2018/0242672 A1 Aug. 30, 2018

Related U.S. Application Data

(63) Continuation of application No. PCT/US2017/044217, filed on Jul. 27, 2017.

(60) Provisional application No. 62/368,116, filed on Jul. 28, 2016.

(51) Int. Cl.
*A41G 5/02* (2006.01)

(52) U.S. Cl.
CPC ..... *A41G 5/02* (2013.01)

(58) Field of Classification Search
CPC ..... A41G 5/02; A45D 44/12; A45D 44/005; A45D 44/002; A45D 2200/10; A45D 2/48
USPC ..... 132/201, 53
See application file for complete search history.

(56) References Cited

U.S. PATENT DOCUMENTS 1,831,801 A * 11/1931 Birk ..... A41G 5/02 132/53
2,323,595 A 7/1943 Hanisch
D154,227 S 6/1949 Alvizua
2,618,279 A 11/1952 Reiffert
(Continued)

FOREIGN PATENT DOCUMENTS

CN 303086463 1/2015
CN 304049505 S 2/2017
(Continued)

OTHER PUBLICATIONS

Buzludsha Monument, Gueorguy Stoilov circa 1980, justanotherbackpacker.com, published by blogger Rich on Apr. 29, 2014 © 2019, online, site visited Aug. 27, 2019. Available from Internet, URL: http://www.justanotherbackpacker.com/ buzludzha-monument-bulgaria-ufo/ (Year: 2014).
(Continued)

*Primary Examiner* — Rachel R Steitz
*Assistant Examiner* — Brianne E Kalach
(74) *Attorney, Agent, or Firm* — Foley & Lardner LLP

(57) ABSTRACT

Clusters of artificial lashes are initially formed using, for example, a hot melt method in which artificial hairs secured to one another following exposure to a heat source. Multiple clusters can then be connected to one another to form a lash fusion. For example, a lash fusion could include three clusters that are connected together in a straight line. Multiple lash fusions can be arranged proximate to one another to form a set. In some embodiments, the multiple lash fusions are positioned such that the form of the set matches the curvature of the tightline of an eyelid. An adhesive can then be applied to the top of each lash fusion in the set, which enables an individual to easily apply the set directly
(Continued)

to the underside of the individual's natural eyelashes (i.e., near the underside of the eyelid beneath the lash line).

22 Claims, 10 Drawing Sheets

(56) References Cited

U.S. PATENT DOCUMENTS 3,454,015 A * 7/1969 Udes ..... A41G 5/02 132/201
3,557,653 A 1/1971 Kim
3,561,454 A 2/1971 O'connell
3,625,229 A 12/1971 Silson
3,670,742 A 6/1972 Weaner
3,900,038 A 8/1975 Masters
D240,769 S 7/1976 Bowman
4,203,518 A 5/1980 Current
4,697,856 A 10/1987 Abraham
D301,371 S 5/1989 Kaprelian
5,033,626 A 7/1991 Platti
D328,246 S 7/1992 Nottingham et al.
5,322,166 A 6/1994 Crowther
D358,312 S 5/1995 Keenan
D379,923 S 6/1997 De Baschmakoff
D387,483 S 12/1997 Sloan
D403,922 S 1/1999 Terraccino
D404,531 S 1/1999 Bakic et al.
5,896,996 A 4/1999 Chuang
D418,253 S 12/1999 Bakic
D443,471 S 6/2001 Lillelund et al.
6,174,321 B1 6/2001 Webb
6,265,010 B1 7/2001 Franco
D448,927 S 10/2001 Vazquez
D454,981 S 3/2002 Lamagna et al.
D456,077 S 4/2002 Etter et al.
D458,413 S 6/2002 Boilen
D463,280 S 9/2002 Brozell
6,471,515 B2 10/2002 Feuer
D472,675 S 4/2003 Lamagna
D472,810 S 4/2003 Gelardi
D473,106 S 4/2003 Scherer
D475,616 S 6/2003 Lambrecht
D479,365 S 9/2003 Todeschini
D481,946 S 11/2003 Nicholson
D481,952 S 11/2003 Orsomando
D483,232 S 12/2003 Liu
D483,909 S 12/2003 Todeschini
D495,834 S 9/2004 Todeschini
D506,573 S 6/2005 de Grandcourt
D507,678 S 7/2005 Lamagna
D512,913 S 12/2005 Gauthier
6,981,814 B2 1/2006 Geardino et al.
D516,247 S 2/2006 Merheje
D522,376 S 6/2006 Hales
D532,891 S 11/2006 Buthier et al.
D533,650 S 12/2006 Ohta
D534,426 S 1/2007 Bakic
D537,208 S 2/2007 Shaljian
D543,662 S 5/2007 Bivona et al.
D543,815 S 6/2007 Metcalf
7,228,863 B2 6/2007 Dumler
D546,002 S 7/2007 Bowen
D561,045 S 2/2008 Lee
D561,942 S 2/2008 Khubani
D569,041 S 5/2008 Azoulay
D569,553 S 5/2008 Cho
D573,308 S 7/2008 Wittke-Kothe
D575,904 S 8/2008 Iqbal
D584,449 S 1/2009 Shaljian
D588,746 S 3/2009 Ross
D591,599 S 5/2009 Okin et al.
D592,923 S 5/2009 Konopka
D595,054 S 6/2009 Whitaker
D602,354 S 10/2009 Dibnah et al.
D604,579 S 11/2009 Robinson et al.
D607,332 S 1/2010 Huntington et al.
7,748,391 B2 7/2010 Vance
D627,103 S 11/2010 Cho
D638,733 S 5/2011 Sullivan
D639,196 S 6/2011 Sullivan
D640,005 S 6/2011 Lee et al.
D647,799 S 11/2011 Dunwoody
D650,669 S 12/2011 Dunwoody
D650,670 S 12/2011 Dunwoody
D651,082 S 12/2011 Dunwoody
D657,496 S 4/2012 Flatt
D661,599 S 6/2012 Floyd et al.
8,225,800 B2 * 7/2012 Byrne ..... A41G 5/02 132/216
D669,223 S 10/2012 Lee
D673,325 S 12/2012 Martines
D690,419 S 9/2013 Porat
8,596,284 B2 12/2013 Byrne
D698,078 S 1/2014 Purizhansky et al.
D700,799 S 3/2014 Ludeman et al.
D707,556 S 6/2014 Kawamura
D714,494 S 9/2014 Vasquez et al.
D716,498 S 10/2014 Wolff
8,939,159 B2 1/2015 Yeo et al.
9,004,299 B2 4/2015 Hardin
9,215,901 B1 12/2015 Schroeder
D753,881 S 4/2016 Hussain et al.
9,314,085 B2 4/2016 Hatch
D755,577 S 5/2016 Segal
9,351,752 B2 5/2016 Slavin
D762,433 S 8/2016 Yang
D764,688 S 8/2016 Robinson et al.
D775,270 S 12/2016 Moffat
D783,899 S 4/2017 Roh
D783,901 S 4/2017 Kim et al.
D784,615 S 4/2017 Choi
D796,582 S 9/2017 Beard
D800,966 S 10/2017 Silva
D810,534 S 2/2018 Liu
D817,132 S 5/2018 Yang
9,993,373 B2 6/2018 Nassif et al.
D823,538 S 7/2018 Ruggaber
D823,683 S 7/2018 Caldwell
D825,333 S 8/2018 Ozamiz et al.
D829,381 S 9/2018 Kim
D830,170 S 10/2018 Holmes
D832,701 S 11/2018 Oates
D836,432 S 12/2018 Riedel et al.
2002/0094507 A1 7/2002 Feuer
2003/0005941 A1 * 1/2003 Iosilevich ..... A41G 5/02 132/53
2003/0111467 A1 6/2003 Norman
2005/0061341 A1 * 3/2005 Choe ..... A41G 5/02 132/53
2005/0166939 A1 8/2005 Stroud
2007/0050207 A1 * 3/2007 Merszei ..... A41G 5/02 705/2
2007/0227550 A1 * 10/2007 Merszei ..... A41G 5/02 132/53
2008/0196732 A1 * 8/2008 Merszei ..... A41G 5/02 132/201
2009/0028625 A1 1/2009 Bonneyrat
2009/0217939 A1 9/2009 Rabe et al.
2009/0223534 A1 9/2009 Green
2009/0266376 A1 10/2009 Beschta
2010/0170526 A1 7/2010 Nguyen
2011/0121592 A1 5/2011 Cho
2011/0278869 A1 11/2011 Lee et al.
2011/0290271 A1 12/2011 Rabe
2013/0110032 A1 5/2013 Luzon
2013/0255706 A1 10/2013 Dinh
2015/0136162 A1 5/2015 Brouillet et al.
2015/0173442 A1 6/2015 Raouf
2015/0216246 A1 8/2015 Ahn et al.
2017/0112264 A1 4/2017 Park
2017/0358245 A1 12/2017 Dana
2018/0065779 A1 3/2018 Chiba
2018/0160755 A1 6/2018 Hansen et al.
2019/0133227 A1 5/2019 Le

(56) References Cited

U.S. PATENT DOCUMENTS

FOREIGN PATENT DOCUMENTS

| | | | |
|---|---|---|---|
| CN | 304049506 | S | 2/2017 |
| CN | 304310042 | S | 10/2017 |
| CN | 304329374 | S | 10/2017 |
| CN | 304329375 | S | 10/2017 |
| CN | 304382151 | S | 12/2017 |
| CN | 304497372 | S | 2/2018 |
| CN | 304777737 | S | 8/2018 |
| CN | 304859863 | S | 10/2018 |
| CN | 304859864 | S | 10/2018 |
| GB | 1021063 | | 2/1966 |
| KR | 20090010717 | U | 10/2009 |
| KR | 101509029 | | 4/2015 |
| WO | WO2018/022914 | | 1/2018 |

OTHER PUBLICATIONS

Cruiser Portable Speaker, NYNE, published at thegamerwithkids.com, posted by Sam Versionone on Apr. 6, 2015 © not listed, https://thegamerwithkids.com/2015/04/06/nyne-cruiser-review-a-wireless-speaker-for-your-bicycle/, downloaded from internet Jun. 20, 2018.

Electron Microscopy Sciences, EMS High Precisions and Ultra Fine Tweezers, https://www.emsdiasum.com.microscopy/products/tweezers/ultra_fine.aspx, downloaded from the internet Feb. 13, 2019 (7 pages).

Focallure, https://shopfocallure.com/collections/eyelashes/products/eyelash-tweezer-by-focallure, downloaded from internet Feb. 14, 2019 (1 page).

Hongjun web page, https://detail.1688.com/offer/574685154983.html?spm=a2615.7691456.newlist.75.22f96dc5Msy00t, downloaded from the Internet Oct. 31, 2018 (16 pages).

Japonesque False Lash Applicator, https://japonesque.com/products/implements/false-lash-applicator/, downloaded from internet Feb. 13, 2019 (6 pages).

Lashify Wand, https://www.instagram.com/p/BWqeQ8wg00S/?igshid=zaulyw8a6v5, downloaded from internet 2019 (1 page).

Madame Madeline Lashes, Ardell Dual Lash Applicator, https://www.madamemadeline.com/online_shoppe/proddetail.asp?prod=mm62059, downloaded from internet Oct. 18, 201 (3 pages).

Pak Lajpall, Nail Artist Tweezers PL-1, http://www.laipall.com/proddetail.php?prod=nail-artist-tweezers_1, downloaded from internet Feb. 13, 2019 (1 page).

Amazon, Ocamo False Eyelashes Curler Stainless Steel Extension Eye Lash Applicator Remover Tweezers Clip Makeup Tools, https://www.amazon.kin/Ocamo-Eyelashes-Stanless-Extension-Applicator/dp/B07FT5XW8C?tag=googinhydr18418-21&tag=googinkenshoo-21&ascsu . . . , downloaded from internet Oct. 10, 2018 (3 pages).

Born Pretty, False Eyelashes Thick Natural Simulation Recyclable Curly False Eyelash Makeup Cosmetic Tools , http://www.bornprettystore.com/false-eyelashes-thick-natural-simulation-recyclable-curly-false-eyelash-makeup-cosmetic-tools-p-44675.htmldownloaded from internet Oct. 18, 2018 (6 pages).

Buy Korea, Plastic, False Eyelash Applicator, Multy colour, http://www.buykorea.or.kr/product-details/Plastic-False-Eyelash-Applicator-Multy-colour-3106709.html, downloaded from internet Feb. 14, 2019 (3 pages).

Cosmopolitan, You've Been Applying False Eyelashes Wrong Your Whole Life, https://www.cosmopolitan.com/style-beauty/beauty/how-to/a55781/this-false-eyelash-hack-will-change-your-life/, Mar. 25, 2016 (12 pages).

Delicate Hummingbird, Ha! I've mastered the false lashes!, http://delicatehummingbird.blogspot.com/2011/11/ha-ive-mastered-false-lashes.html, Nov. 10, 2011 (12 pages).

Dream Lashes Curved Volume Tweezer—3 Minute Test, https://www.youtube.com/watch?vwgYeE0SD7s, downloaded from the internet Feb. 13, 2019.

Image Essentials, How to wear false eyelashes without looking like you're wearing them, https://imagessentials.wordpress.com/2012/03/30/how-to-wear-false-eyelashes-without-looking-like-youre-wearing-any/, Mar. 30, 2012 (5 pages).

International Search Report and Written Opinion dated Mar. 12, 2018 in related PCT/2017/067513 filed Dec. 20, 2017 (10 pages).

International Search Report and Written Opinion dated Nov. 27, 2017 in related PCT/US2017/044217 filed Jul. 27, 2017 (10 pages).

Lashify Gossamer Lash Cartridge https://lashify.com/collections/shop-1/products/gossamer-eye-lozenge-c-style?variant=783670738950, downloaded from internet Jun. 15, 2018 (2 pages).

MAC Cosmetics, 34 Lash, http://www.bornprettystore.com/false-eyelashes-thick-natural-simulation-recyclable-curly-false-eyelash-makeup-cosmetic-tools-p-44675.html, downloaded from internet Feb. 14, 2019 (1 page).

Made in China, New Product Eyelashes Aid Eyelashes Applicator Innovative Eyelashes Curler, 2018, https://www.made-in-china.com/productdirectory.do?word=creative+eyelashe+curler&subaction=hunt&style=b&mode=and&code=0&comProvince=nolimit&order=0&isOpenCorrection=1, downloaded from internet Feb. 13, 2019 (2 pages).

Peonies and Lilies, Bourjois 2 in 1 Tweezers and Faux & Fabulous Eyelashes, posted Oct. 24, 2012 (2 pages).

* cited by examiner

ARTIFICIAL LASH EXTENSIONS

CROSS-REFERENCE TO RELATED APPLICATIONS

This application is a continuation of International Application No. PCT/US17/44217, filed on Jul. 27, 2017, which claims priority to U.S. Provisional Application No. 62/368,116, filed on Jul. 28, 2016. The contents of the above applications are incorporated herein by reference in their entirety.

FIELD OF THE INVENTION

Various embodiments concern artificial eyelashes and, more specifically, clusters of artificial eyelash extensions that can be applied to the underside of an individual's natural eyelashes.

BACKGROUND

Eyelash extensions have conventionally been used to enhance the length, thickness, and fullness of natural eyelashes. Eyelash extensions, however, must be applied to an individual's natural eyelashes one by one to avoid having the eyelash extensions stick together. Consequently, lash extension services can cost hundreds of dollars depending on the type and number of lashes used, the skill of the cosmetician, and the venue where the eyelash extensions are applied. It usually takes an experienced cosmetician one to two hours to attach a full set of eyelash extensions.

Clusters of artificial lashes have conventionally been used to enhance the length, thickness, and fullness of an individual's natural eyelashes. However, each cluster must be applied to the individual's eyelashes individually in order to avoid having the clusters of artificial lashes stick together and to ensure multiple clusters are evenly distributed across the width of the individual's lash line.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

BRIEF DESCRIPTION OF THE DRAWINGS

Various embodiments are illustrated by way of example and not limitation in the accompanying drawings, in which like references indicate similar elements. Various objects, features, and characteristics of the present invention will become more apparent to those skilled in the art from a study of the Detailed Description in conjunction with the accompanying drawings.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Conventional eyelash extensions (or simply "lash extensions") are individually adhered to an individual's eyelashes one-by-one in order to prevent the eyelash extensions from sticking together. However, because the average individual might have anywhere from thirty to eighty lashes per eye, the application process can take several hours to attach a full set of eyelash extensions.

Introduced here, therefore, are techniques for creating clusters of artificial lash extensions that can be applied to an individual's natural eyelashes. Clusters of artificial lashes include multiple artificial hairs made of natural materials (e.g., silk or authentic mink hair) or synthetic materials (e.g., acrylic resin, polybutylene terephthalate (PBT), or synthetic mink hair made of polyester). A cluster of artificial lashes generally includes approximately 10 to 30 artificial hairs (and preferably 10 to 20 artificial hairs). Clusters of artificial lashes are initially formed using, for example, a hot melt method in which artificial lashes are heated. For example, in some embodiments linear artificial lashes are heated at one end such that they begin to fuse to one another at that end, while in other embodiments linear artificial lashes are heated near a central point and folded underneath one another. Clusters of artificial lashes have conventionally been made available only to professional lash technicians and cosmeticians.

Figure 1:
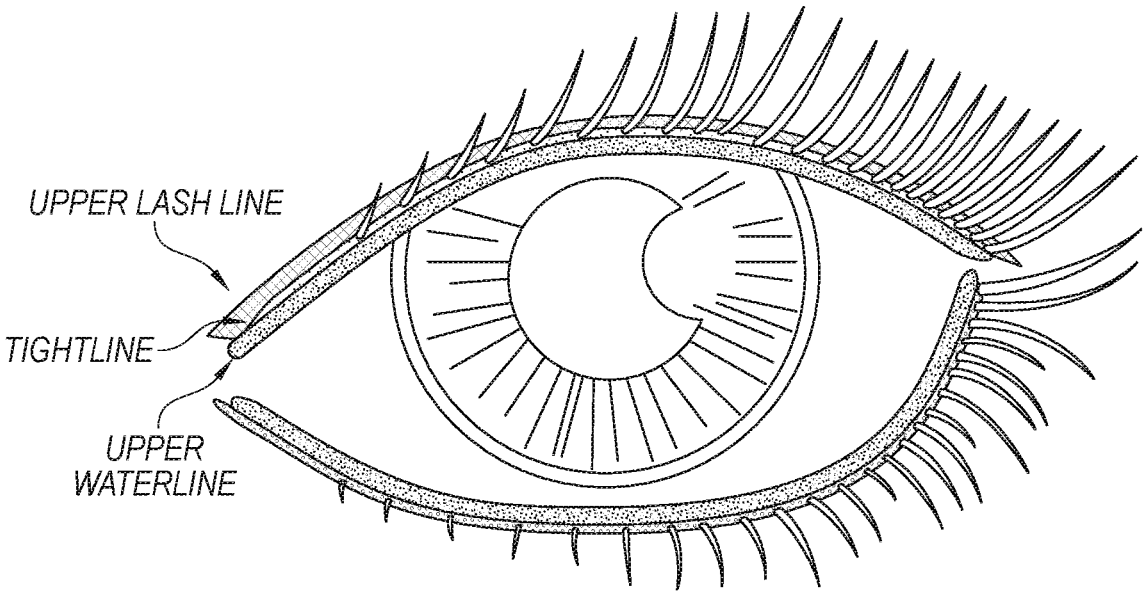
FIG. 1 depicts the upper tightline, upper lash line, and upper waterline of an eyelid.

Multiple clusters can then be fused together to form a bundle (also referred to as a "lash fusion") that can be applied along the upper tightline in a single motion. As shown in FIG. 1, the upper tightline is interposed between the upper lash line and the upper waterline. While certain embodiments have been described in the context of lash fusions that include multiple clusters, those skilled in the art will recognize that a lash fusion could also include a series of individual artificial hairs that are connected to one another.

More specifically, a lash fusion can include multiple clusters that are fused together near the inner ends of the artificial lashes (also referred to as the "base" of the lash fusion) to form a straight line of artificial hairs that can be placed underneath an individual's natural lashes. For example, the multiple clusters can be fused together (e.g., via a heat seal process) approximately 1-5 millimeters (mm) above the base via crisscrossing artificial hairs. In some embodiments, the multiple clusters are fused together approximately 1.5-2.5 mm above the base. The distance from the base at which fusing occurs may depend on the desired fan-out of the artificial lashes (e.g., shorter distances may cause a larger fan-out). Adjacent clusters can be secured to one another when the intersecting portions of the crisscrossing artificial hairs are fused together. Such a technique allows a set of multiple lash fusions to appear seamless and blend in with an individual's natural lashes.

The base of the lash fusion (i.e., where the multiple clusters are fused together) is intended to be affixed to an individual's natural lashes. The lash fusion may be approximately 4-8 mm wide. A lash fusion could include 3-10, 3-7, 5-10, 5-7, or 4-6 clusters. Accordingly, a lash fusion could include 30-150, 30-120, or 30-90 individual artificial hairs.

A set of multiple lash fusions can then be formed by arranging the multiple lash fusions next to one another in a form that matches the curvature of the upper tightline along the base of an eyelid. While the multiple lash fusions are typically not connected to one another (e.g., are not fused together using heat, an adhesive, etc.), the entire set can be applied to the underside of the individual's natural lashes in a single motion. A set could include 3-8, 3-5, 5-8, or 4-6 lash fusions. Accordingly, a set could include 150-360 individual artificial hairs.

The number of lash fusions in a set may vary. In fact, because the multiple lash fusions are typically not secured to one another, an individual could decide to apply part of a set (e.g., five lash fusions rather than six lash fusions) based on the desired density.

Density of the artificial hairs may vary across the width of the eyelid. In some embodiments the artificial hairs are distributed evenly across the entire tightline (i.e., each cluster/lash fusion can include a substantially similar number of artificial lashes), while in other embodiments the artificial hairs are more densely populated in certain area(s) of the tightline (i.e., some clusters/lash fusions may include fewer artificial lashes than others). For example, density may be lower along the outer edge opposite the tear duct.

An adhesive may be applied to the top of each lash fusion within a set during the manufacturing process, which enables an individual to easily apply the set of lash fusions directly to the underside of the individual's eyelashes rather than to the individual's eyelid. Additionally or alternatively, the individual could apply an adhesive before applying the set of lash fusions to the individual's natural eyelashes. For example, the individual may apply an adhesive to the set of lash fusions before applying the set of lash fusions to the natural eyelashes. As another example, the individual could apply an adhesive directly to the natural eyelashes. The adhesive could be a waterproof glue or mascara.

Terminology

Brief definitions of terms, abbreviations, and phrases used throughout this application are given below.

Reference to "one embodiment" or "an embodiment" means that a particular feature, structure, or characteristic described in connection with the embodiment is included in at least one embodiment of the disclosure. The appearances of the phrase "in some embodiments" are not necessarily referring to the same embodiment, nor are they necessarily referring to separate or alternative embodiments that are mutually exclusive of one another.

The terms "connected," "coupled," or any variant thereof includes any connection or coupling between two or more elements, either direct or indirect. The coupling or connection between the elements can be physical, logical, or a combination thereof. For example, two components may be coupled directly to one another or via one or more intermediary channels/components. The words "associate with," meanwhile, mean connecting or relating objects, items, etc.

System Topology Overview

Figure 2:
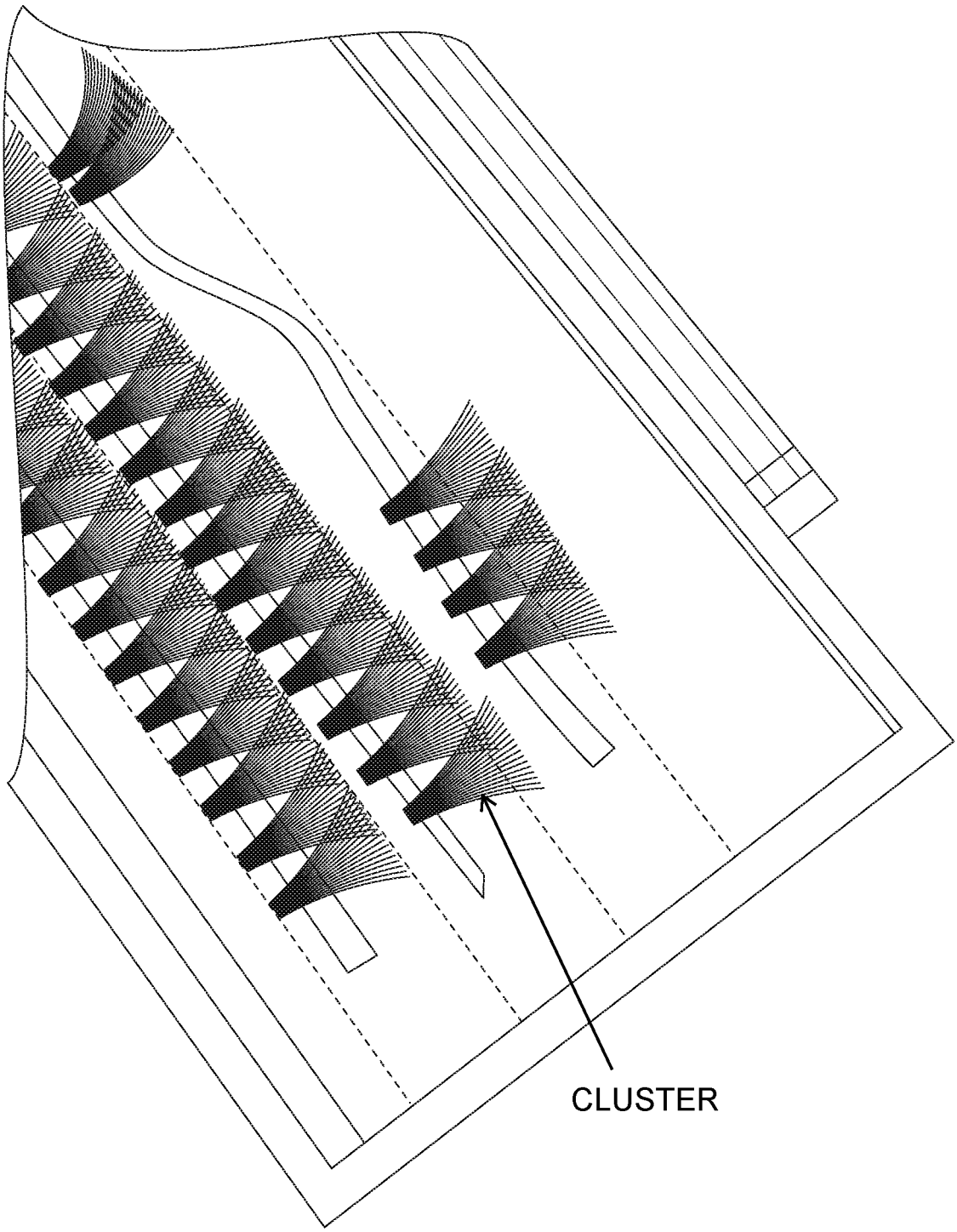
FIG. 2 depicts clusters of artificial lashes that can be used by professional lash technicians and cosmeticians.

FIG. 2 depicts clusters of artificial lashes that can be used by professional lash technicians and cosmeticians. Each cluster of artificial lashes includes multiple artificial hairs that consist of natural materials (e.g., silk or authentic mink hair) or synthetic materials (e.g., acrylic resin, PBT, or synthetic mink hair made of polyester).

Clusters of artificial hairs typically include 10 to 30 hairs that are heated (e.g., as part of a hot melt process) and then secured to one another. For example, in some embodiments linear artificial lashes are heated at one end such that they begin to fuse to one another at that end, while in other embodiments linear artificial hairs are heated near a central point and folded underneath one another.

In some embodiments, some or all of the artificial hairs within a cluster may be tied to a support thread (i.e., knotted). The artificial hairs may be tied by any such means, such as a slip knot that prevents horizontal spreading of the cluster.

Figure 3A:
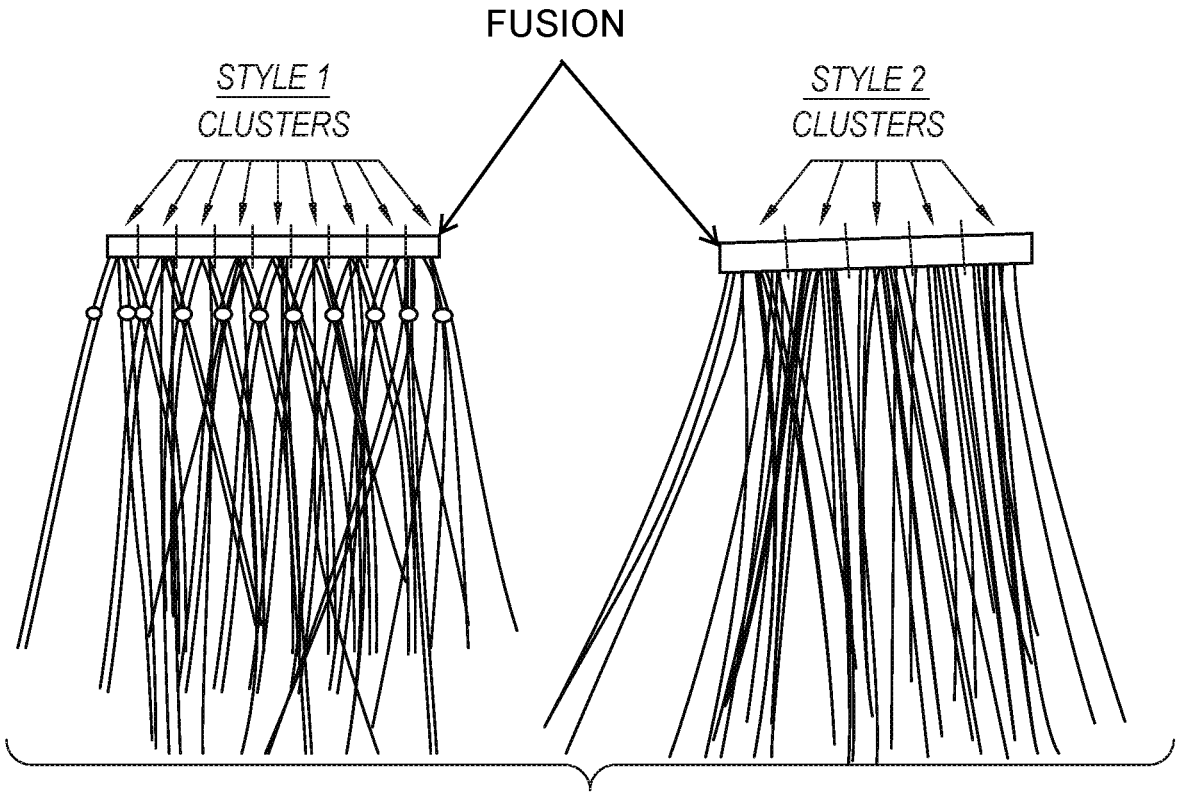
FIG. 3A depicts how multiple clusters of artificial lashes can be connected to form a bundle (also referred to as a "lash fusion").

FIG. 3A depicts how multiple clusters of artificial lashes can be connected to form a bundle (also referred to as a "lash fusion"). More specifically, the lash fusion can include multiple clusters that are fused together near the base to form a straight line of artificial hairs that can be applied along the upper tightline.

For example, the multiple clusters can be fused together (e.g., via a heat seal process) approximately 1-5 mm above the base via crisscrossing artificial hairs. In some embodiments, the multiple clusters are fused together approximately 1.5-2.5 mm above the base. Adjacent clusters can be secured to one another when the intersecting portions of the crisscrossing artificial hairs are fused together. Such a technique allows a set of multiple lash fusions to appear seamless and blend in with an individual's natural lashes.

The intersecting portions of the crisscrossing artificial hairs could also be connected using an adhesive (i.e., rather than being fused together via a hot melt process). In such embodiments, the multiple clusters may be exposed to a curing assembly (e.g., a heater, dryer, or light source) that causes the adhesive to solidify. Artificial lashes made of natural materials (e.g., human or authentic mink hair) are typically connected using a glue or other adhesive rather than through the hot melt process.

A lash fusion could include 3-10, 3-7, 5-10, 5-7, or 4-6 clusters. Accordingly, a lash fusion could include 30-90 individual artificial hairs. Here, for example, a first style of lash fusion includes nine clusters, while a second style of lash fusion includes five clusters.

Note, however, that both styles could include the same number of artificial lashes. For example, the first style of lash fusion may include nine clusters of five artificial lashes each, while the second style of lash fusion may include five clusters of nine artificial lashes each. Both styles could also include different numbers of artificial lashes (e.g., the first style may include a higher density of artificial lashes, and thus be more appropriate for placement near the tear duct).

Lash fusions may be 4-8 mm wide, though embodiments are often 5-6 mm wide. This is much wider than conventional clusters (which are 1.5-2 mm wide), and thus provide greater coverage along the eyelid.

Figure 3B:
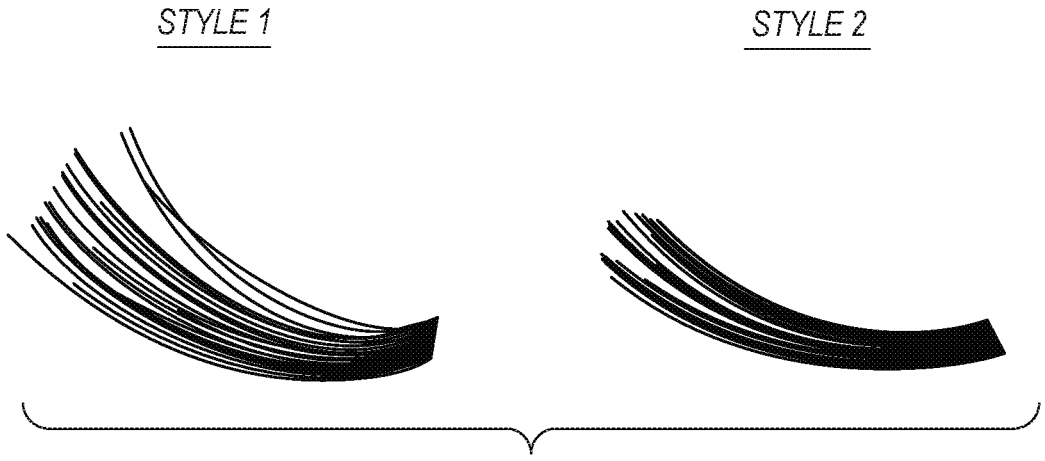
FIG. 3B is a side view of two different styles of lash fusion.

FIG. 3B is a side view of two different styles of lash fusion. The multiple clusters of each lash fusion can be fused to one another (e.g., during a hot melt process). Such a design provides several advantages over conventional clusters of lash extensions.

For example, because the multiple clusters can be heat sealed to one another, the total height at the base of the lash fusion is only 0.05-0.15 mm. Conventional clusters, meanwhile, use a string at the base to connect the artificial hairs to one another. But the presence of the string causes the total height at the base of the cluster to exceed 0.3 mm (e.g., typically 0.3-0.7 mm).

Moreover, the lash fusions described here have no quantifiable weight. Therefore, the lash fusions can more easily adhere to an individual's natural lashes and remain secured for longer periods of time. Again, the presence of the string causes conventional clusters to have a quantifiable weight that affects how they must be adhered to the individual's natural lashes.

Figure 3C:
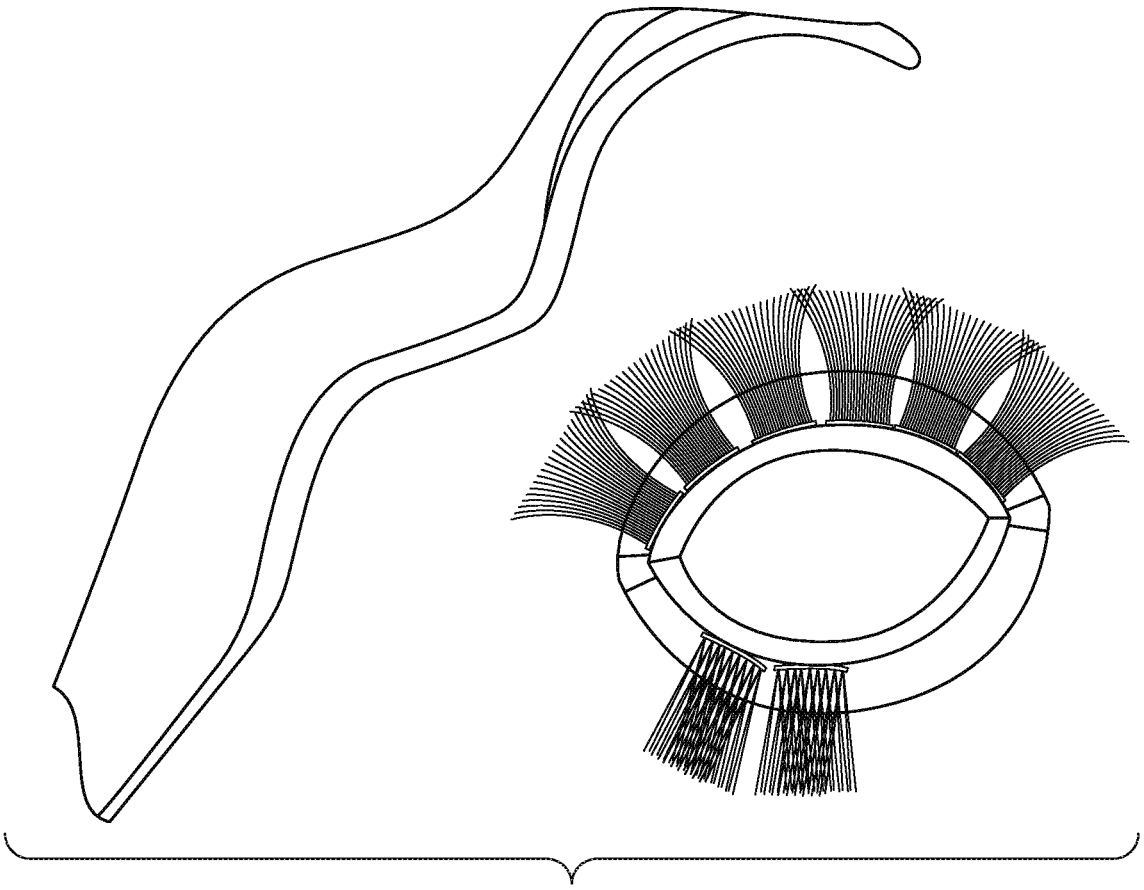
FIG. 3C illustrates how a set of multiple lash fusions can be secured to an individual's lashline in a single motion.

FIG. 3C illustrates how a set of multiple lash fusions can be secured to an individual's lashline in a single motion. A set can include multiple lash fusions that are arranged to match the curvature of the upper tightline of an eyelid. For example, multiple lash fusions may be arranged such that the inner ends (i.e., the bases) form a concave shape that substantially complements the universal tightline of nearly any human eye. In some embodiments, sets preferably include five to seven distinct clusters of artificial lashes. The number of lash fusions within each set (as well as the number of clusters within each lash fusion) may be based on the thickness of the artificial hair used, the desired style of the eyelid on which the set is intended to be affixed, the desired lash density (also referred to as "fullness" of the individual's lashes), etc. As shown in FIG. 3C, the set of lash fusions is aligned with the tightline rather than the lash line, and then affixed to the underside of the individual's natural lashes. Said another way, the set of lash fusions is applied directly to the underside of the natural lashes rather than to the eyelid.

An adhesive can be applied to the top of each lash fusion in the set, which enables an individual to easily apply the set directly to the natural lashes. The individual responsible for applying the set of lash fusions could be a person who affixes the lash fusions to herself or some other person (e.g., a professional lash technician or a cosmetician). In some embodiments, the adhesive is applied when the lash fusions and/or the set are initially manufactured. Additionally or alternatively, the individual could apply an adhesive before attaching the set of lash fusions to the individual's natural lashes.

The adhesive could be a waterproof (semi-permanent) glue, mascara, or some other co-polymer solution having an adhesive quality. Although latex-based adhesives are generally avoided to avoid irritation of the individual's eyelid (e.g., due to an allergic reaction), adhesives can include various other natural and/or chemical ingredients. Examples of possible adhesives include:

Arcrylates/ethylhexyl acrylate copolymer, aqua, propylene glycol, ceteareth-25, hydrogenated castor oil, glycerin, phenoxyethanol, 2-bromo-2-nitropropane-1, 3-diol, methylcholoroisothiazolinone, methylisothiazolinone, methylparaben, and optionally a color agent (e.g., black 2 (C177266));

Polyterpene, styrene/isoprene copolymer, petrolatum, polyisobutene, microcrystalline wax (cera microcristalina, cire microcrystalline), hydrogenated styrene/methyl styrene/indene copolymer, styrene/VA copolymer, and optionally an antioxidant (e.g., butylated hydroxytoluene (BHT));

Chlorine dioxide, p-anisic acid, biotin, *lavandula angustifolio* oil, propylene glycol, water, 2-ethylhexyl acrylate, and optionally a preservative (e.g., benzalkonium chloride); and Acrylate copolymer and water.

Those skilled in the art will recognize that many other adhesive compositions are possible and, in fact, may be desirable for individuals having certain allergies, desiring certain fixation duration (also referred to as "permanency" of the lash extensions), etc.

Semi-permanent clusters of lash extensions may be applied with a Federal Drug Administration-approved (FDA-approved) adhesive that achieves a strong bond. Such adhesives generally include cyanoacrylate. Different types of cyanoacrylates (e.g., ethyl, methyl, propyl, butyl, and octyl) have been designed for bonding to different surfaces. For example, adhesives made from methyl-2-cyanoacrylateare are designed to bond a smooth surface (e.g., the lash extension) to a porous surface (e.g., the natural eyelash), but not on the skin as it may cause irritation.

Figure 4:
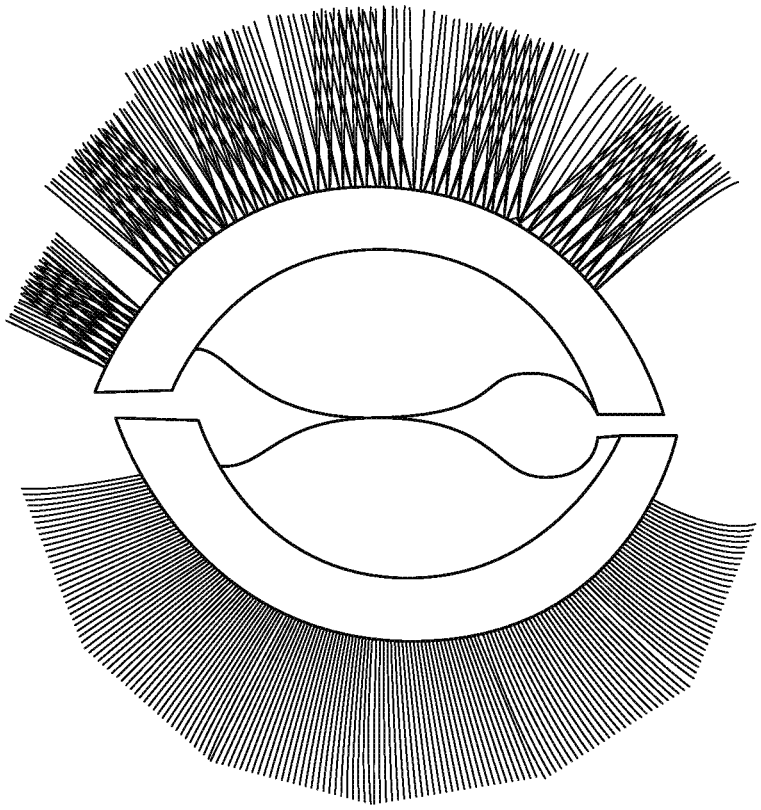
FIG. 4 illustrates how multiple lash fusions within a set can be positioned in a specified arrangement.

FIG. 4 illustrates how multiple lash fusions within a set can be positioned in a specified arrangement. While the multiple lash fusions within the set will typically not be connected to one another, the multiple lash fusions can be arranged such that the set substantially complements the shape of an eyelid. More specifically, the curvature of the multiple lash fusions may substantially match the tightline curvature of an average person. Thus, an entire set of lash fusions may become substantially flush with the lash line when the set is arranged proximate to the tightline. Together, the multiple lash fusions form a set of lash extensions that can be collectively applied in a single motion.

Figure 5:
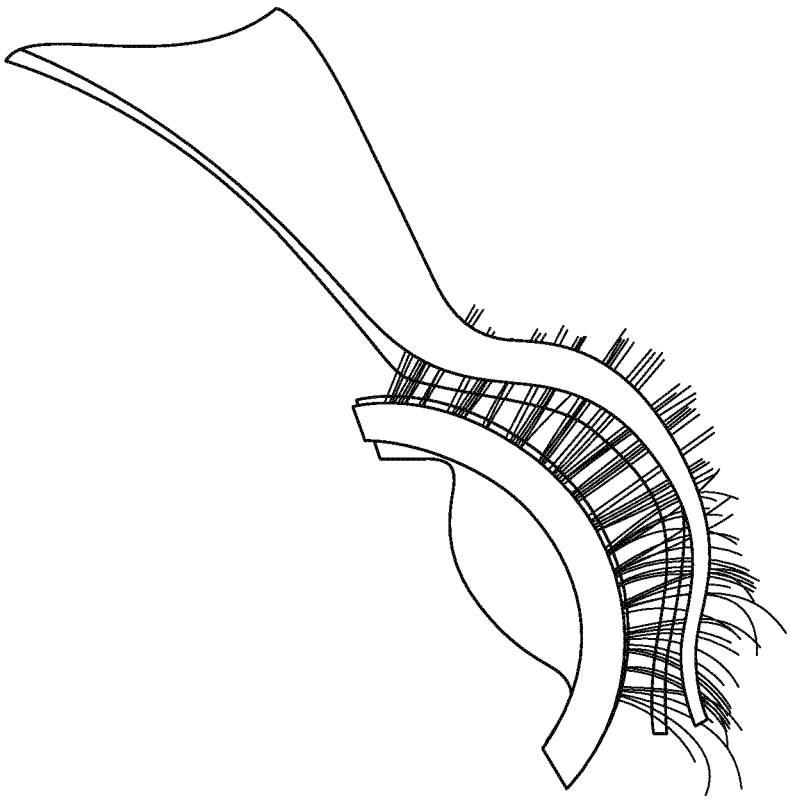
FIG. 5 depicts how the arrangement of the set of lash extensions enables all of the lash fusions to be simultaneously grasped by an applicator.

FIG. 5 depicts how the arrangement of the set of lash extensions enables all of the lash fusions to be simultaneously grasped by an applicator. More specifically, an individual or a healthcare professional, such as a lash technician or cosmetician, can grasp an entire set of lash extensions using the applicator and simultaneously apply the entire set of lash extensions to the individual's natural eyelashes in a single motion.

Figure 6:
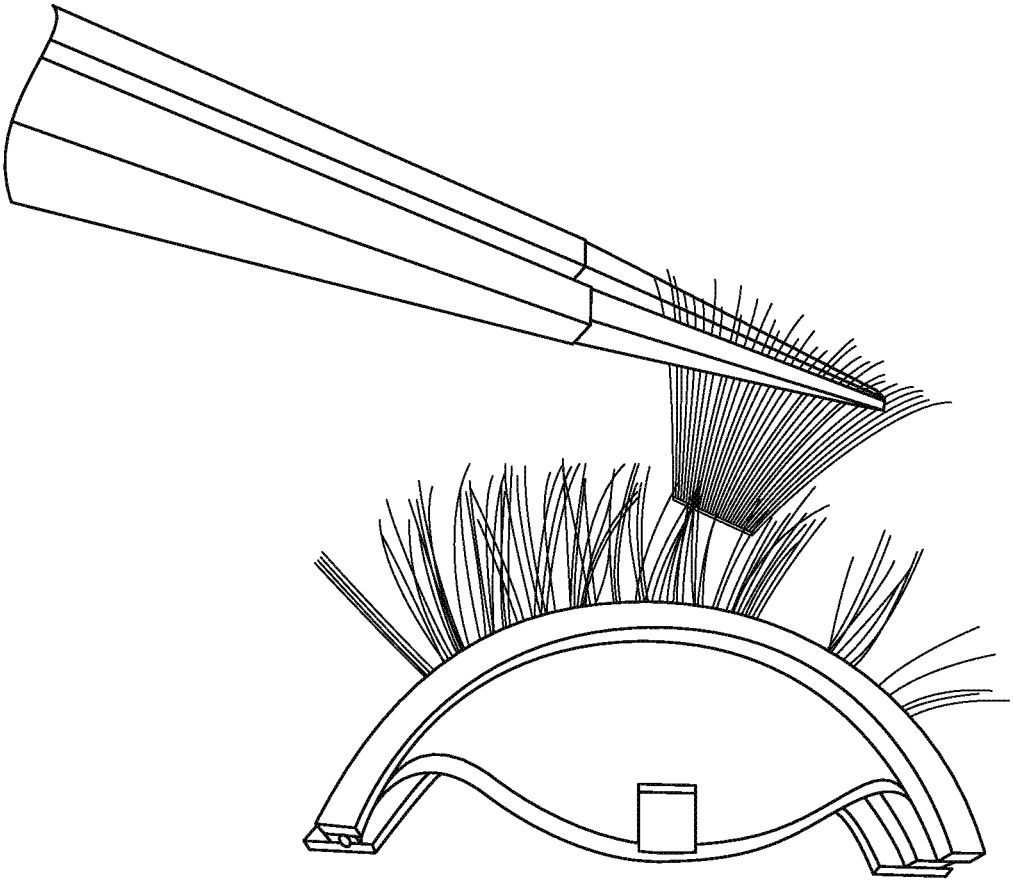
FIG. 6 depicts how the set of lash fusions can be placed underneath an individual's natural lashes, where the plastic represents the individual's eyelid.

FIG. 6 depicts how the set of lash fusions can be placed underneath an individual's natural lashes, where the plastic represents the individual's eyelid. As further described below, an adhesive is applied to the top of each lash fusion in the set of lash extensions. Consequently, the set of lash extensions can be applied directly to the underside of the individual's natural lashes proximate to the tightline, rather than to the eyelid above the lash line.

Figure 7:
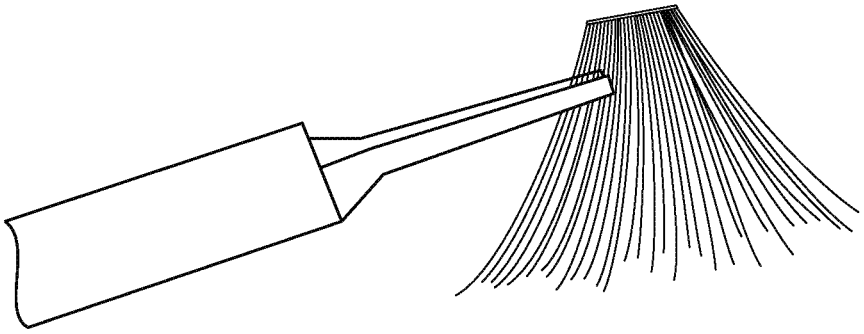
FIG. 7 depicts how an adhesive can be applied to the top of an entire set of lash extensions or to the lash fusions that make up the set.

FIG. 7 depicts how an adhesive can be applied to the top of an entire set of lash extensions or to the lash fusions that make up the set. Additionally or alternatively, an adhesive could be applied to the individual's natural lashes. The adhesive applied to the artificial lash extensions may the same adhesive applied to the individual's natural lashes or a different adhesive.

Such a technique enables the individual to easily apply the set of lash extensions directly to the underside of the individual's natural lashes proximate to the tightline, rather than to the individual's eyelid adjacent to the lash line. While multiple lash fusions are typically arranged with the intention that they be simultaneously grasped and applied to the individual's natural lashes, the individual could also individually apply the lash fusions.

The adhesive could be a semi-permanent glue or mascara. In some embodiments, the adhesive includes an oil-soluble polymer or a water-soluble polymer that helps to enhance adhesion and substantivity of the artificial lash extensions to the individual's natural eyelashes. The adhesive may be a waterproof formulation that allows the set of lash extensions to remain affixed to the individual's natural lashes for longer periods of time (e.g., days, weeks, or months).

Although latex-based adhesives are generally avoided to avoid irritation of the individual's eyelid (e.g., due to an allergic reaction), adhesives can include various other natural ingredients (e.g., sugar or honey) and/or chemical ingredients. For example, copolymer is often a main ingredient in many adhesive formulations. The adhesive could be a commercially-available adhesive for conventional lash extensions or a specialized composition for use with the set of lash extensions described herein. The adhesive could be clear or colored (e.g., milky white or black to emulate mascara).

Figure 8:
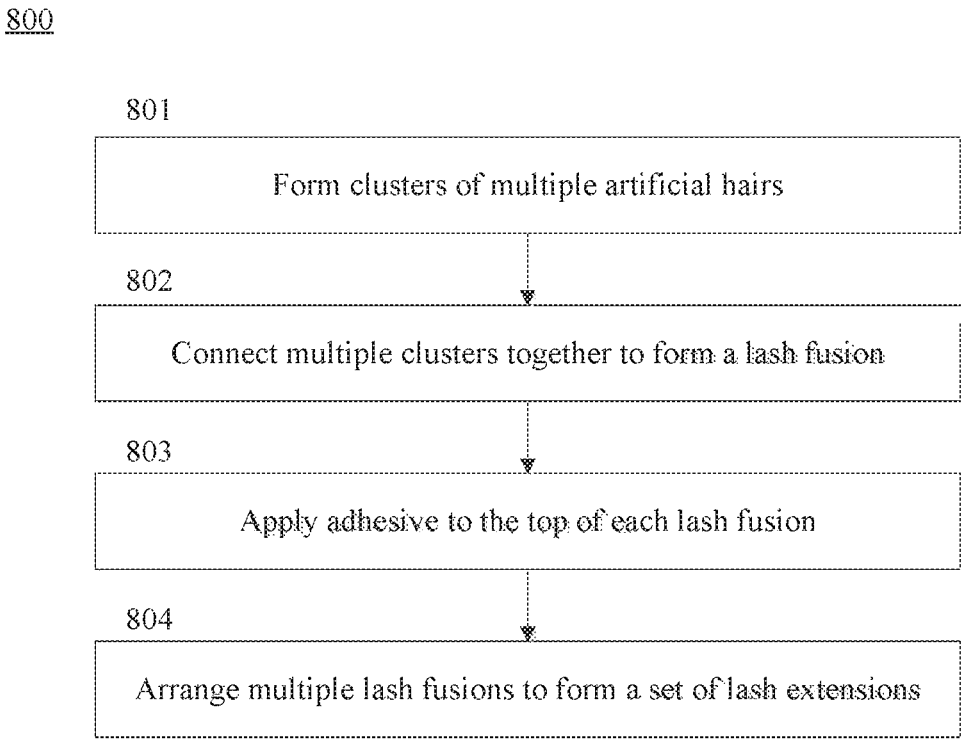
FIG. 8 depicts a flow diagram of a process for manufacturing a lash fusion including multiple clusters of artificial lashes.

FIG. 8 depicts a flow diagram of a process 800 for manufacturing a lash fusion including multiple clusters of artificial lashes. Clusters of artificial lashes are initially formed using, for example, a hot melt method in which artificial hairs are heated and connected to one another (step 801). In some embodiments, linear artificial hairs are heated at one end such that they begin to fuse to one another at that end, while in other. In other embodiments, linear artificial hairs are heated near a central point and folded proximate to the central point (i.e., so that a single artificial hair appears as two artificial lashes). Artificial hairs can then be overlapped (e.g., near the fused end or central fold) to form a cluster.

The hot melt method requires that the multiple artificial hairs be heated to a temperature that is sufficient to cause the individual lashes to begin to melt. For example, artificial hairs made of PBT could be heated to approximately 55-110° C. at one end during a heat seal process (during which the heated ends begin to fuse to one another). Note, however, that clusters could include artificial hairs that consist of natural materials (e.g., silk or authentic mink hair) or synthetic materials (e.g., acrylic resin, PBT, or synthetic mink hair made of polyester). While clusters may include 10 to 90 artificial hairs, most clusters include 10 to 30 artificial hairs.

Multiple clusters can then be connected together to form a lash fusion (step 802). More specifically, the lash fusion can include multiple clusters that are fused together near one end (i.e., the base) to form a straight line of artificial hairs that can be placed underneath an individual's natural lashes.

For example, the multiple clusters could be connected together using a hot melt method substantially similar to the hot melt method used to form the individual clusters. As noted above, the hot melt method requires that the multiple clusters be heated to a temperature that is sufficient to cause the individual lashes to begin to melt. Thus, clusters made of PBT could be heated to approximately 55-110° C. (e.g., 65° C.) near one end. For example, the clusters could be heated approximately 1.5-2.5 mm above the base. As the individual artificial hairs begin to melt, the multiple clusters will connect to one another near the base to form a straight line of artificial hairs, thereby forming a lash fusion.

As another example, the multiple clusters could be connected together using a glue or some other adhesive composed of various substances. In such embodiments, the clusters may be exposed to a curing assembly (e.g., a heater, dryer, or light source) that causes the adhesive to solidify. Thus, after multiple clusters have been formed (e.g., via a hot melt process), the multiple clusters may be glued to one another to form a lash fusion. Artificial lashes made of natural materials (e.g., human or authentic mink hair) are typically connected using a glue or other adhesive rather than through the hot melt process.

An adhesive (e.g., a pressure-sensitive adhesive) can then be applied to the top of the lash fusion (step 803). The adhesive may enable an individual to subsequently apply the lash fusion directly to the underside of the individual's natural lashes. Additionally or alternatively, the individual could apply an adhesive before applying the lash fusion to the natural lashes.

In some embodiments, multiple lash fusion are positioned in a specified arrangement to form a set of lash extensions (step 804). For example, 4-6 lash fusions could be arranged such that the inner ends (i.e., the bases) of the lash fusions form a concave shape that substantially complements the tightline of an eyelid. While the lash fusions are typically not connected to one another (e.g., are not fused together using heat, an adhesive, etc.), the entire set could be applied to the underside of the individual's natural lashes in a single motion.

Figure 9:
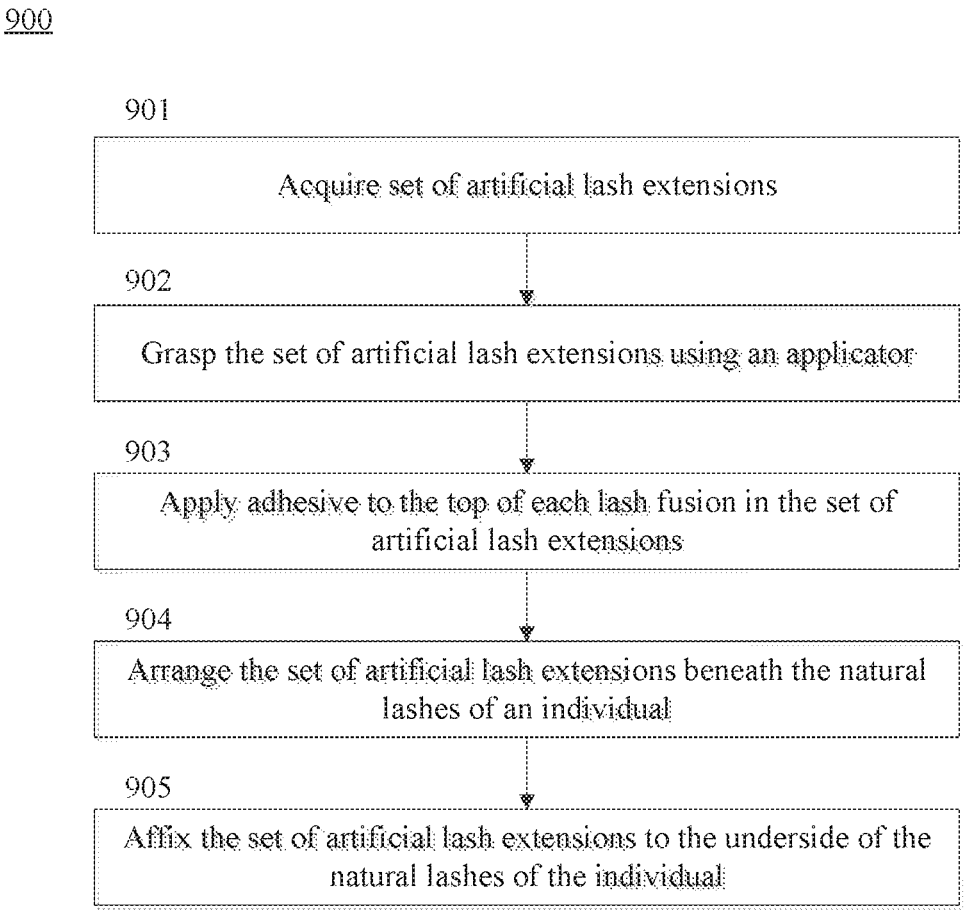
FIG. 9 depicts a flow diagram of a process for applying a set of lash extensions to an individual's natural eyelashes.

FIG. 9 depicts a flow diagram of a process 900 for applying a set of artificial lash extensions to an individual's natural lashes. The set of lash extensions is initially acquired by the individual or a healthcare professional, such as a lash technician or cosmetician (step 901). The set of artificial lash extensions can include multiple lash fusions, each of which is comprised of multiple clusters of artificial lashes. The set of artificial lash extensions can then be grasped using an applicator (step 902). The applicator may be designed so that the entire set of artificial lash extensions (i.e., all of the lash fusions) can be seized and removed (e.g., from a surface to which the set of artificial lash extensions are attached) in a single motion.

In some embodiments an adhesive is applied to the top of each lash fusion in the set of artificial lash extensions (step 903), while in other embodiments an adhesive is applied to the top of each lash fusion in the set of artificial lash extensions during the manufacturing process. The adhesive could be, for example, a waterproof glue or mascara. The set of artificial lash extensions can then be arranged proximate to the tightline beneath the individual's natural lashes (step 904) and affixed to the underside of the individual's natural lashes (step 905), rather than to the individual's eyelid above the lash line.

Unless contrary to physical possibility, it is envisioned that the steps described above may be performed in various sequences and combinations. For instance, an adhesive could be applied to the individual clusters before or after the clusters are formed into lash fusions. Other steps could also be included in some embodiments.

Remarks

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

What is claimed is:

1. A method comprising:

obtaining a set of clusters of artificial eyelashes that form a set of lash fusions that are connected to a base in order to form a set of lash extensions, wherein each cluster of the set of clusters is heat fused at its root, wherein the set of clusters is further heat fused adjacent to each other to form the base;

grasping the set of lash fusions via an applicator;

applying an adhesive to a top side of the set of lash fusions;

arranging the set of lash extensions via the applicator proximate to a proximate end portion of only an underside of a natural upper eyelash of a subject such that the base extends proximate to the natural upper eyelash; and affixing the set of lash extensions only to the underside of the natural upper eyelash of the subject such that the top side adheres to the underside via the adhesive.

2. The method of claim 1, wherein at least one cluster of the set of clusters of artificial eyelashes includes at least 10 hairs and no more than 20 hairs.

3. The method of claim 2, wherein at least one lash fusion of the set of lash fusions includes at least 30 hairs and no more than 90 hairs.

4. The method of claim 3, wherein the set of lash extensions includes at least 150 hairs and no more than 360 hairs.

5. The method of claim 1, wherein the set of lash fusions is distributed along the base at a substantially constant density.

6. The method of claim 1, wherein the adhesive comprises cyanoacrylate.

7. Method of claim 1, wherein the adhesive is applied directly to the top side of the set of lash fusions.

8. Method of claim 1, wherein the adhesive is applied indirectly to the top side of the set of lash fusions.

9. A method comprising:

causing a user to access a set of clusters of fibers that form a set of lash fusions that are connected to a base in order to form a set of lash extensions, wherein the user has a natural upper eyelash having an underside with a proximate end portion, wherein the set of lash fusions has a top side, wherein the lash fusions extend lateral to the base, wherein each cluster of the set of clusters of fibers is heat fused at its root, wherein the set of clusters of fibers is further heat fused adjacent to each other to form the base;

causing the user to apply an adhesive to at least one of the top side or the underside;

causing the user to position the set of lash extensions adjacent to the proximate end portion such that the base extends adjacent to the natural upper eyelash; and causing the set of lash extensions to be removably coupled to the underside such that the top side adheres to the underside via the adhesive.

10. The method of claim 9, wherein the set of clusters of fibers is fused via a heat seal process.

11. The method of claim 9, wherein the set of clusters of fibers is formed via fusing a plurality of fibers to one another along a plurality of ends thereof by exposing the ends to a heat source.

12. The method of claim 9, wherein the set of clusters of fibers includes a plurality of adjacent clusters that overlap each other.

13. The method of claim 9, wherein the set of clusters of fibers is formed via heating a plurality of clusters of fibers to a temperature that causes at least a partial melting of at least some fibers in the clusters.

14. The method of claim 9, wherein the user is caused to apply the adhesive to the top side.

15. The method of claim 9, wherein the user is caused to apply the adhesive to the underside.

16. The method of claim 9, wherein the user is caused to apply the adhesive directly to at least one of the top side or the underside.

17. The method of claim 9, wherein the user is caused to apply the adhesive indirectly to at least one of the top side or the underside.

18. A method comprising:

causing a user to access a set of clusters of fibers that form a set of lash fusions that define a base in order to form a set of lash extensions, wherein the user has a natural upper eyelash having an underside with a proximate end portion, wherein the set of lash fusions has a top side, wherein the lash fusions extend lateral to the base, wherein each cluster of the set of clusters of fibers is heat fused at its root, wherein the set of clusters of fibers is further heat fused adjacent to each other to form the base;

causing the user to apply an adhesive to at least one of the top side or the underside;

causing the user to position the set of lash extensions adjacent to the proximate end portion such that the base extends adjacent to the natural upper eyelash; and causing the set of lash extensions to be removably coupled to the underside such that the top side adheres to the underside via the adhesive.

19. The method of claim 18, wherein the user is caused to apply the adhesive directly to at least one of the top side or the underside.

20. The method of claim 18, wherein the user is caused to apply the adhesive indirectly to at least one of the top side or the underside.

21. The method of claim 18, wherein the set of clusters of fibers is fused via a heat seal process.

22. The method of claim 18, wherein the set of clusters of fibers is formed via heating a plurality of clusters of fibers to a temperature that causes at least a partial melting of at least some fibers in the clusters.

* * * * *